United States Patent [19]

Kinose et al.

[11] Patent Number: 5,028,457

[45] Date of Patent: Jul. 2, 1991

[54] ROLL COATING APPARATUS AND METHOD CAPABLE OF PROVIDING COATINGS WITHOUT PIN HOLES

[75] Inventors: Kazuo Kinose; Masato Tanaka, both of Shiga, Japan

[73] Assignee: Dainippon Screen Mfg. Co., Ltd., Japan

[21] Appl. No.: 565,885

[22] Filed: Aug. 9, 1990

Related U.S. Application Data

[63] Continuation of Ser. No. 278,188, Nov. 30, 1988, abandoned.

[30] Foreign Application Priority Data

Nov. 30, 1987 [JP] Japan ..... 62-182845
Feb. 19, 1988 [JP] Japan ..... 63-21567

[51] Int. Cl.[5] ..... B05D 1/36; B05C 1/12

[52] U.S. Cl. ..... 427/258; 118/224; 118/249; 118/255; 118/262; 427/402; 427/428

[58] Field of Search ..... 118/249, 259, 262, 255, 118/224, 227; 427/258, 259, 402, 428, 359

[56] References Cited

U.S. PATENT DOCUMENTS 2,704,530 3/1955 Nilsen et al. ..... 118/224
2,772,604 12/1956 Muggleton ..... 118/224 X
3,301,156 1/1967 Roeber ..... 118/249 X
3,552,353 1/1971 Labombarde ..... 118/249 X
3,636,918 1/1972 Fischer et al. ..... 118/249 X
4,384,544 5/1983 Weishew ..... 118/262 X
4,524,715 6/1985 Abrams ..... 118/249 X
4,603,060 7/1986 Mitsuda et al. ..... 118/249 X

FOREIGN PATENT DOCUMENTS 203665 11/1984 Japan .
209676 11/1984 Japan .
65778 3/1987 Japan ..... 118/259

OTHER PUBLICATIONS

Semiconductor World, 1987.7, pp. 160–165, 1987.

*Primary Examiner*—Richard L. Chiesa
*Attorney, Agent, or Firm*—Osterlenk, Faber, Gerb & Soffen

[57] ABSTRACT

An improved roll coating apparatus and method includes a coating roll having a smooth surface for applying a resist, a doctor roll having grooves on its surface for supplying prescribed amount of the resist to the coating roll, and a back up roll which is in contact with the coating roll for conveying a substrate on which the resist is applied to a prescribed direction. Even if there are minute concave portions on the surface of the substrate, the resist is forced to fill the minute concave portions, since the resist is pressed and forced to be applied on the substrate by the coating roll having smooth surface and the back up roll.

15 Claims, 8 Drawing Sheets

ROLL COATING APPARATUS AND METHOD CAPABLE OF PROVIDING COATINGS WITHOUT PIN HOLES

This is a Continuation of application Ser. No. 07/278,188 filed on Nov. 30, 1988, now abandoned.

BACKGROUND OF THE INVENTION

1. Field of the Invention

The present invention generally relates to a roll coating apparatus for applying a coating on a surface of a substrate by means of a roller. More specifically, the present invention relates to a roll coating apparatus for applying a coating on an uneven surface of a thin plate substrate.

2. Description of the Prior Art

Roll coaters have been well known. A roll coater is used for applying a photoresist liquid to form a polysilicon pattern on a surface of a substrate such as a semiconductor and the like. In manufacturing a thermal head, for example, a metal film is deposited on a glass substrate, and a photoresist pattern is formed on the metal film utilizing a roll coater. FIG. 1 shows a schematic cross section of the roll coater. Referring to FIG. 1, a conventional roll coater comprises a coating roll 1 for applying a resist liquid R on a substrate 5, a doctor roll 2 in contact with the coating roll 1 to apply the resist liquid R to the coating roll, and a back up roll 3 adjacent to the coating roll 1 for conveying the substrate 5. The resist liquid R is supplied through a resist liquid supplying apparatus 6 to a space defined by the coating roll 1 and the doctor roll 2. The amount of the resist liquid R supplied on the coating roll 1 is adjusted by adjusting the pressure with which the doctor roll 2 pressing against the coating roll 1. As a result a constant thickness of resist liquid R is applied to the surface of the substrate 5 inserted between the coating roll 1 and the back up roll 3.

FIG. 2 shows a cross section of the substrate 5. Referring to FIG. 2, an aluminum metal thin film having the thickness of about 1 μm is deposited on the surface of the substrate 5. Prescribed portions of the metal thin film are etched to form metal thin film pieces 9 on the substrate 5. The resist liquid R is applied over the surface of the substrate 5 and the metal thin film pieces 9 to a thickness of about 4 μm by means of the roll coater. Consequently, air cavities 10 may be formed around the outer periphery of the metal thin film pieces 9. If the resist liquid R has high viscosity, a large number of cavities 10 are generated. In that cast, the film formed of the resist liquid R tears in the succeeding step of drying, thereby forming pin holes. Consequently, the quality of the substrate is degraded.

In order to solve the above described problem, the applicant of the present application discloses a method in Japanese Patent Laying-Open Gazette Number 209676/1984. FIG. 3 shows an arrangement of the roll coaters disclosed in the foregoing publication. Referring to FIG. 3, roll coaters A1 and A2 are arranged successively along a conveyer path of the substrate 5. First grooves are formed on the surface of a coating roll 1 of the inlet side roll coater A1. Second grooves are formed on the surface of a coating roll 1' on the outlet side roll coater A2. FIG. 4A shows the coating roll of the inlet side roll coater A1 and FIG. 4B is an enlarged view of the portion shown by IVB of FIG. 4A. Referring to FIGS. 4A and 4B, the first grooves each have a width of $W_1$. FIG. 5A shows the outlet side roll coater A2 and FIG. 5B is an enlarged view of the portion shown by VB of FIG. 5A. Referring to FIGS. 5A and 5B, each of the second grooves have a width of $W_2$. Referring to FIGS. 4B and 5B, the width $W_2$ of the groove 11' of the outlet side roll coater is greater than the width $W_1$ of the groove 11 of the inlet side roll coater A1. Since the width $W_2$ of the grooves 11' of the coating roll of the outlet side roll coater A2 is greater than the width $W_1$ of the inlet side roll coater A1, more coating liquid is applied to the substrate 5 by coater A2 than coater A1. Specifically, if the depth of the groove is constant, the amount of the coating liquid applied to the substrate 5 is in proportion to the width of the groove. In accordance with the roll coating method shown in FIG. 3, a thin film of the coating liquid R is formed by the inlet side roll coater A1. Therefore, even if a cavity 10 is generated upon application of the thin layer of coating liquid R by the inlet side roll coater A1, the air in the cavity easily escapes. Thereafter, a thicker film of the coating liquid is applied on the substrate 5 by the coating roll 1' of the outlet side roll coater A2. Since there is already a cavityless thin layer of coating liquid R on the substrate 10 the surface tension of the coating liquid causes the thicker layer of coating liquid R applied by the outlet side roll coater A2 to be evenly applied without the formation of an cavities. Consequently, a coating having a desired uniform film thickness is formed on the substrate.

Meanwhile, an article entitled ¢Manufacturing Process of a Liquid Crystal Color Panel" is reported in *SEMICONDUCTOR WORLD,* July, 1987, pp. 160–165. FIGS. 6 and 7 are schematic cross sectional views illustrating the manufacturing process of a polysilicon TFT (Thin Film Transistor) for liquid crystal disclosed in the article.

Referring to FIGS. 6 and 7, the manufacturing process of the TFT disclosed in the above mentioned article will be schematically described. On a main surface of a transparent glass substrate $L_1$, a polysilicon film $L_2$ having source and drain regions, a gate insulating film ($SiO_2$) $L_3$, a second polysilicon film $L_4$ which will serve as a gate electrode, and an interlayer insulating film ($SiO_2$) $L_5$ are formed as shown by solid lines in FIG. 6. An indium tin oxide film (ITO film) $L_6$ is formed as shown by a two dotted lines of FIG. 6, in order to form a connection (a portion shown by $L_{61}$ in FIG. 7) for driving signals and a pixel electrode for a liquid crystal display (a portion shown by $L_{62}$ in FIG. 7). A photoresist $L_7$ is applied on the surface of the indium tin oxide film $L_6$. Consequently, a connection portion $L_{61}$ for driving signals and a pixel electrode $L_{62}$ for the LCD are formed on the polysilicon film $L_2$ having the source and drain regions, as shown in FIG. 7.

The succeeding steps of manufacturing the TFT have no relation with the present invention so that the description thereof will be omitted.

As shown in FIG. 6, a contact hole H is formed in the connection portion. The contact hole H has a diameter of several μm to several 10 μm and a depth of several μm. The coating liquid (such as a resist) can not be applied on the above mentioned contact hole H by any of the conventional roll coaters shown in FIGS. 1, 3, 4A, 4B, 5A and 5B. Consequently, pin holes are generated.

FIG. 8 illustrates the main causes of the above described pin holes. As described with reference to FIGS. 4B and 5B, the conventional coating roll has grooves.

Sometimes the groove of the coating roll coincides with the position of the contact hole and sometimes it does not. FIG. 8 shows a case in which a concave air hole 19 formed in the coating liquid R in the groove 11 of the coating roll 1 coincides with the position of the contact hole H. In this case, the contact hole H is not filled with the coating liquid R. Consequently, a pin hole may possibly be generated.

If a pin hole is generated, there will be a defect in at least one of the signal line $L_{61}$ and the pixel electrode $L_{62}$ shown in FIG. 7, and the circuit will not operate.

SUMMARY OF THE INVENTION

Therefore, one object of the present invention is to provide a roll coating apparatus capable of applying coating liquid in a substrate having minute concave portions and convex portion without causing the development of any pin holes thereon.

Another object of the present invention is to provide a roll coating apparatus by means of which the coating liquid is applied to have a uniform thickness and no pin hole is generated in the coating film.

A further object of the present invention is to provide a roll coating apparatus by means of which the thickness of the coating liquid applied on the substrate can be controlled, such that the formation of pin holes in the coating liquid will be prevented.

A still further object of the present invention is to provide a roll coating apparatus capable of applying coating liquid such that the contact hole is fully filled with the coating liquid, when a wiring portion is formed in manufacturing a TFT.

The above described objects of the present invention can be attained by a coating apparatus applying coating liquid comprising: a roller having a smooth cylindrical outer surface for applying coating liquid on a substrate with the roller being in contact with the substrate; a doctor apparatus which can be in contact with the roller, for forming a space between the first roller and the apparatus itself for holding coating liquid; and a supporting apparatus provided adjacent to the roller, for conveying the substrate by nipping the substrate between the roller and the supporting apparatus.

In the coating apparatus of the present invention, the coating liquid is applied on the substrate by means of a roller having a smooth cylindrical outer surface. Since no groove is formed on the roller, the coating liquid fills a pin hole of the substrate, if any. Therefore, a coating apparatus can be provided by means of which no pin hole is generated in the coating film, even if there are minute concave portions and convex portions on the surface of the substrate.

According to a preferred embodiment of the present invention, the doctor apparatus comprises a doctor roller which has an external surface provided with a plurality of grooves each having a prescribed dimension.

Since grooves are formed on the doctor apparatus, a prescribed amount of the coating liquid is supplied uniformly to the roller. Consequently, a roll coating apparatus can be provided by means of which the coating liquid is applied to a uniform thickness and no pin hole is generated in the coating film.

According to a more preferred embodiment of the present invention, the said coating apparatus further comprises a coating apparatus provided on the downstream of the substrate conveying direction.

The coating apparatus comprises: second roller for applying coating liquid on the substrate with the second roller being in contact with the substrate; second doctor apparatus which can be in contact with the second roller for holding the coating liquid between the second doctor apparatus and the second roller; and a second supporting apparatus provided adjacent to the second roller for conveying the substrate by nipping the substrate between the second supporting apparatus and the second roller; where the second roller comprises a second outer surface provided with a plurality of grooves each having a prescribed dimension.

Since the coating apparatus comprises the above described components, the coating apparatus on the upstream side prevents the generation of pin holes on the surface of the coating, and the coating apparatus on the downstream side controls the thickness of the amount of coating, that is, the thickness of the coating film. Consequently, a roll coating apparatus can be provided in which the film thickness of the coating applied on the substrate can be controlled and no pin hole is generated therein.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 9:
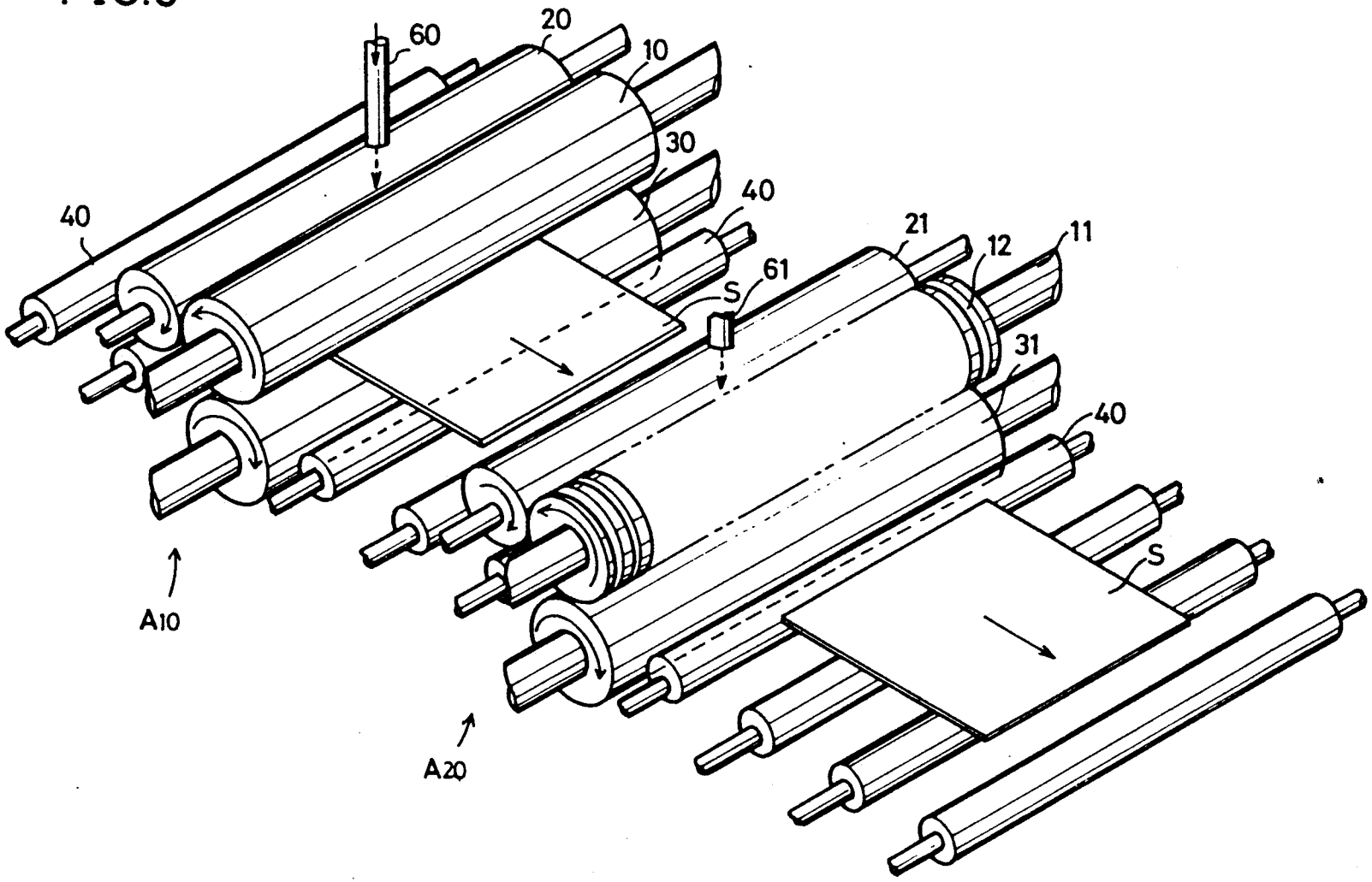
FIG. 9 is a perspective view showing a first embodiment of a coating apparatus in accordance with the present invention.

FIG. 9 is a perspective view showing a first embodiment of the roll coating apparatus in accordance with the present invention. Referring to FIG. 9, a first embodiment of the roll coating apparatus of the present invention comprises a first roll coater A10 provided on the upstream side of the substrate conveying direction; a second roll coater A20 provided on the downstream side; and conveying rollers 40 for conveying a substrate S provided on the upstream side and on the downstream side of the first and second roll coaters A10 and A20. The first roll coater A10 comprises a coating roll 10 whose surface is processed to be flat; a doctor roll 20 for supplying a coating liquid (resist or the like) onto the coating roll 10; a back up roll 30 provided adjacent to the coating roll 10 for conveying the substrate S between the coating roll and itself; and a coating liquid supplying nozzle 60 for supplying the coating liquid between the coating roll 10 and the doctor roll 20. The reason for this is that the rubber doctor roll can not cope with a large liquid crystal display apparatus, which has been remarkably developed recently.

The second roll coater A20 on the downstream side comprises a coating roll 11 formed with a plurality of grooves; a doctor roll 21 for supplying the coating liquid to the coating roll 11; a back up roll 31 arranged opposed to the coating roll 11 for conveying the substrate S between itself and the coating roll; and a coating liquid supplying nozzle 61 for supplying coating liquid to a space formed by the coating roll 12 and the doctor roll 21.

The width of the grooves 12 formed on the outer surface of the coating roll 11 are selected to provide a coating having a desired film thickness to a surface of the substrate S. The coating roll 11 on which grooves 12 are formed is preferably formed of an elastic member, for example, rubber, resin, or the like.

In the first and second roll coaters A10 and 120, the doctor rolls 20 and 21 are preferably separated from the coating rolls 10 and 12 by an arbitrary distance, respectively. The aim for this is at arbitrarily setting the thickness of the coating applied on the substrate S.

The manner of application of the coating onto the substrate S will be described in the following. In the apparatus shown in FIG. 9, the substrate S conveyed in a horizontal direction. The substrate S is inserted between the coating roll 10 and the back up roll 30 of the first roll coater A10. On this occasion, the back up roll 30 to which the substrate is conveyed is fixed and the coating roll 10 and the doctor roll 20 which is in contact with the coating roll 10 can be moved upward. While the substrate S is inserted between coating roll 10 and the back up roll 30, the coating liquid on the surface of the coating roll 10 is brought into contact with the substrate S to be uniformly applied thereon. On this occasion, even if a concave portion such as a contact hole exists in the substrate S, the coating liquid is forced to fill the concave portion due to the pressing effect of the coating roll 10 and the back up roll 30 and the fact is that no groove is formed on the coating roll 10. After the substrate S is coated by means of the first roll coater A10, the substrate S is transferred to the second roll coater A20. In the second roll coater A20, the amount of coating is determined and controlled by the grooves formed on the coating roll. The coating liquid is further applied on the substrate by the second roll coater A20. Thereafter, the surface of the coating film becomes flat due to the surface tension of the coating liquid applied on the substrate S, whereby a coating film of a desired thickness is formed on the substrate S.

Figure 14:
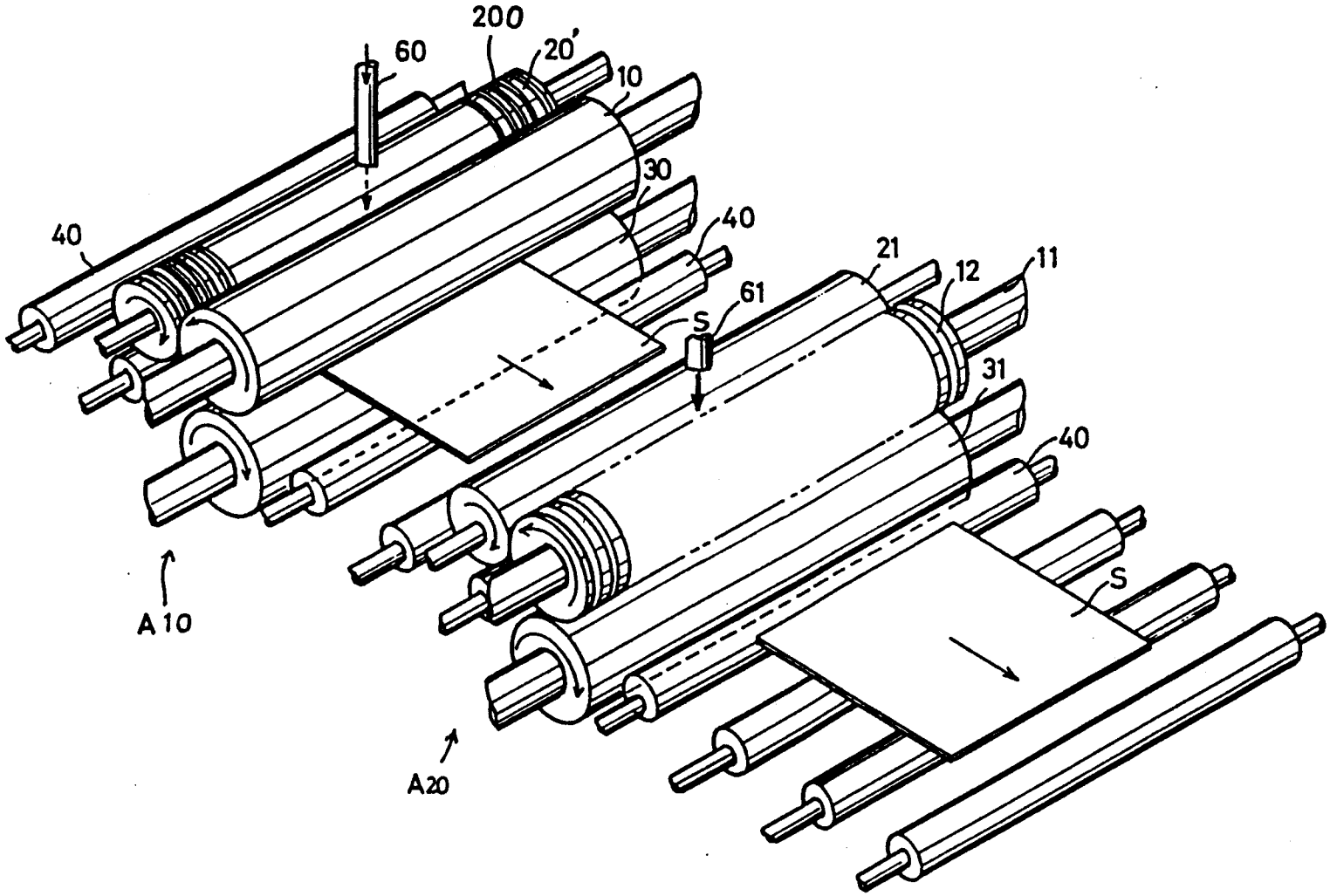
FIG. 14 is a perspective view depicting a second embodiment of the invention.

FIG. 14 is a perspective view illustrating a second embodiment of the invention. Unlike the first embodiment, a doctor roll 20' of the first roll coater A10 is provided with plural grooves 200 on the outer periphery thereof. The roll coater system in accordance with this embodiment is particularly suitable for providing various film thickness, since double provision of the grooves 200 and 12 on the doctor roll 20' and on the coating roll 11 of respective roll coaters A10 and A20 enables ready control of the thickness by appropriately changing the width and depth of each of the grooves 200 and 12.

Figure 10:
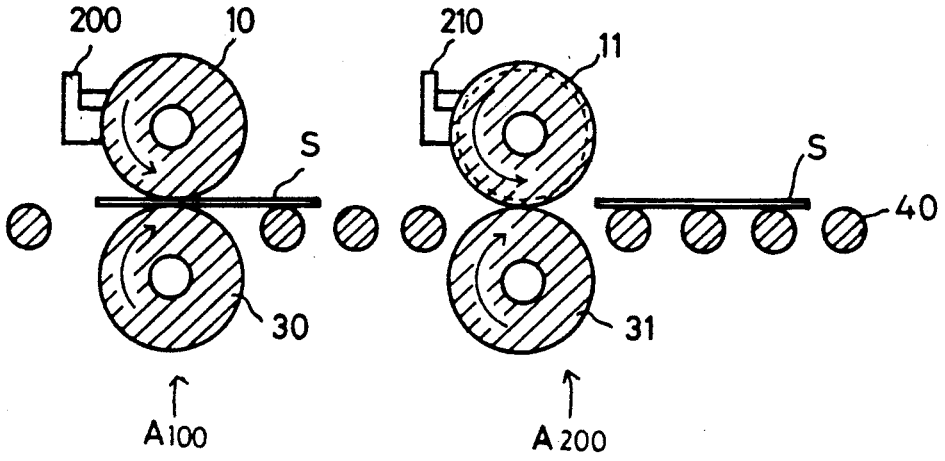
FIG. 10 is a cross sectional view of the coating apparatus in accordance with the third embodiment of the present invention.

FIG. 10 is a cross sectional view of a roll coating apparatus in accordance with a third embodiment of the present invention. In the apparatus of the third embodiment, first and second roll coaters A100 and A200 are successively provided in which doctor bars 200 and 210 are provided instead of the doctor rolls 20 and 21 of the above described first embodiment. The roll coating apparatus of the third embodiment is the same as that of the first embodiment except that the doctor rolls 20 and 21 are replaced with doctor bars 200 and 210. Therefore, the operation, function and effect of the coating rolls 10 and 11 are the same as those in the first embodiment.

A coating film of a prescribed thickness may be formed on the surface of the substrate by applying the technology disclosed in the Japanese Patent Laying-Open Gazette No. 203665/1984 by the applicant of the present application. Specifically, a coating liquid having lower viscosity is applied on the surface of the substrate by the first roll coater A10 or A100, and a coating liquid having a prescribed viscosity or a higher viscosity may be supplied by the second roll coater A20 or A200 comprising a coating roll 11 with grooves.

In association with the above described embodiments, the positions of the first roll coater and the second roll coater on the conveyer path may be reversed and a roll coater similar to the second roll coater may be arranged, so as to successively provide three roll coaters. The same effect as in the above described embodiments can be also provided in this case, as a roll coater having a roll with smooth surface is arranged on the center of the conveyer path. Therefore, a uniform coating without pin holes can be provided on the substrate.

The mechanism of the generation of pin holes during the step of applying coating is complicated, since there are many factors related thereto, such as the viscosity of the coating liquid, the condition of the surface to be coated, the smoothness of the roll. Therefore, the smoothness of the roll having the smooth surface is determined in consideration with these factors. According to a test on the above described TFT substrate, the surface roughness of the roll having smooth surface is preferably less than about 15 $\mu$m.

Figure 11:
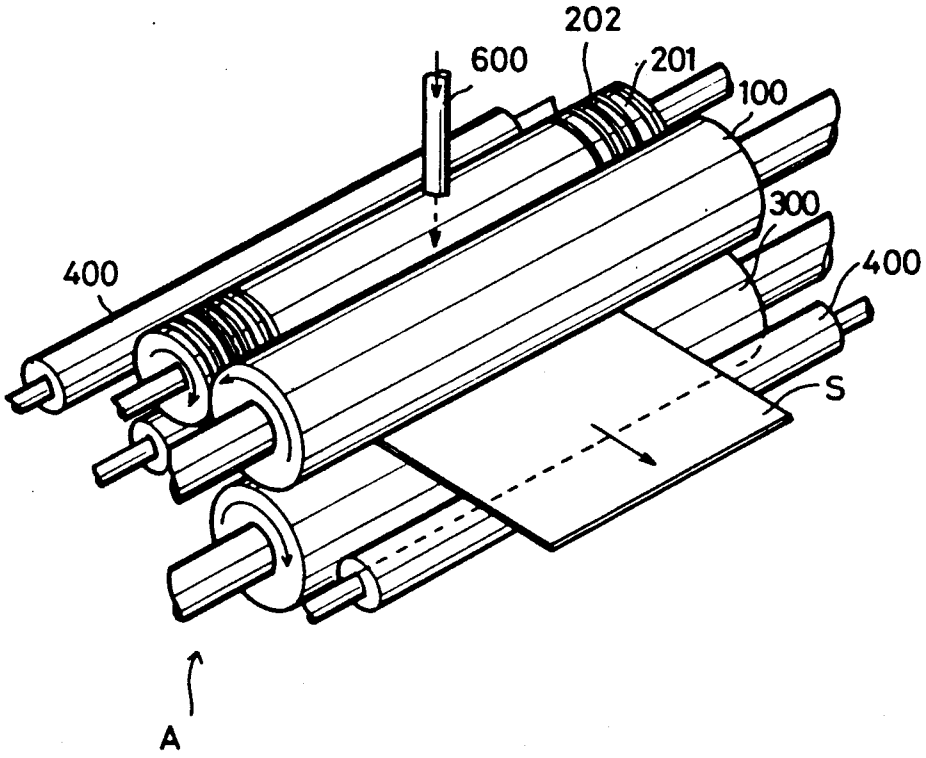
FIG. 11 is a perspective view showing a fourth embodiment of the coating apparatus in accordance with the present invention.

A fourth embodiment of the present invention will be described in the following. Referring to FIG. 11, the roll coating apparatus in accordance with the fourth embodiment of the present invention comprises a roll coater A for applying a coating liquid on the substrate S and a conveyer roll 400 for conveying the substrate S in a prescribed direction. The roll coater A comprises a coating roll 100 for applying the coating liquid; a doctor roll 202 in contact with the coating roll 100 for applying prescribed amount of the coating liquid to the coating roll 100; a back up roll 300 provided adjacent to the coating roll 100 for conveying the substrate S to a prescribed direction between the coating roll 100 and itself; and a coating liquid supplying nozzle 600 for applying the coating liquid to a space formed by the coating roll 100 and the doctor roll 202. Grooves 202 are arranged spaced apart from each other by a prescribed distance on the outer periphery of the doctor roll 201. A film of the coating liquid having a prescribed thickness determined by the shape, dimension and so on of the grooves 202 of the doctor roll 201 is formed on the surface of the coating roll 100. The substrate S is inserted between the coating roll 100 and the back up roll 300. The coating liquid applied on the surface of the coating roll 100 is moved onto the surface of the substrate S while the substrate is conveyed in the prescribed direction. Since no groove is formed on the coating roll 100, the coating liquid is forced to fill concave portions such as contact holes on the substrate S, if any, when the substrate S is pressed with a pressure higher than a prescribed level by the coating roll 100 and the back up roll 300.

In the apparatus of the forth embodiment, the width and dimension of the grooves 202 of the doctor roll 201 are designed to have prescribed values, respectively, in correspondence with the required thickness of the coating film which is to be formed on the surface of the substrate S. The apparatus according to this embodiment is particularly preferred where a control of the film thickness only within a small range is desired.

Figure 12:
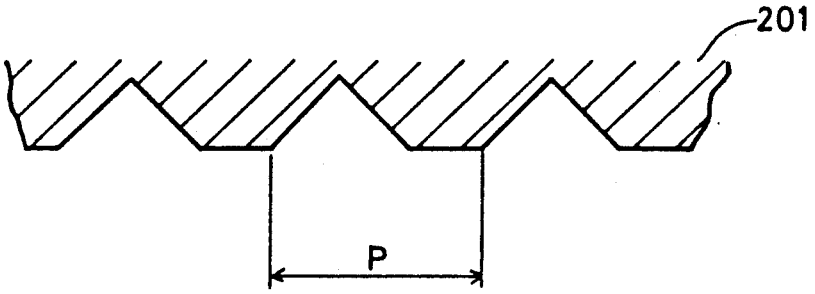
FIG. 12 is a cross sectional view of a doctor roll in accordance with the third embodiment of the present invention shown in FIG. 11.

When a positive photoresist is applied on the surface of the substrate S only by the roll coater A10 of the apparatus shown in FIG. 9, the thickness of the photoresist applied on the surface of the substrate S is 0.5 μm. Meanwhile, when the roll coater A shown in FIG. 11 is used, a photoresist having uniform thickness of about 1.5 μm is applied on the surface of the substrate S. The shape of the grooves on the doctor roll 201 of the roll coater A is shown in FIG. 12. Referring to FIG. 12, the groove on the doctor roll 201 is spirally formed on the cylindrical surface of the doctor roll with the pitch P of the groove being P=150 μm. If the pitch P of the groove is made smaller, the amount of the coating liquid applied on the coating roll 100 is reduced, whereby the thickness of the film on the surface of the substrate S becomes thinner.

Figure 1:
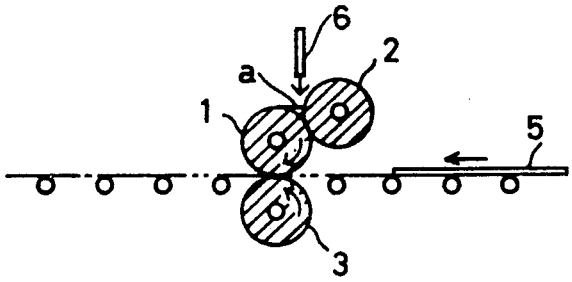
FIG.1 PRIOR ART
FIG. 1 is a cross sectional view of a conventional roll coater.
Figure 2:
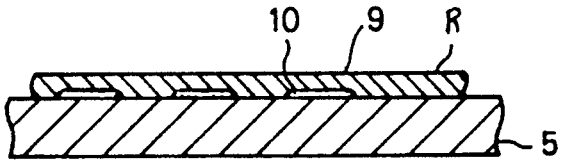
FIG.2 PRIOR ART
FIG. 2 illustrates the generation of pin holes when a coating is applied on a substrate by a conventional roll coater.
Figure 3:
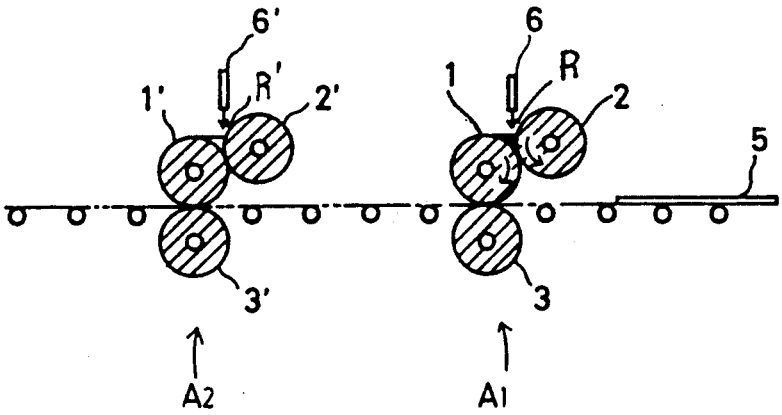
FIG.3 PRIOR ART
FIG. 3 illustrates an improved conventional method for applying coating, suppressing the generation of pin holes.
Figure 4A:
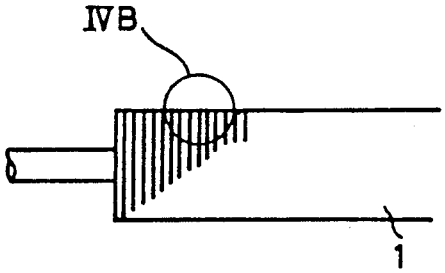
FIG.4A PRIOR ART
FIGS. 4A and 4B show grooves of a coating roll of an inlet side roll coater of the conventional improved roll coaters shown in FIG. 3.
Figure 4B:
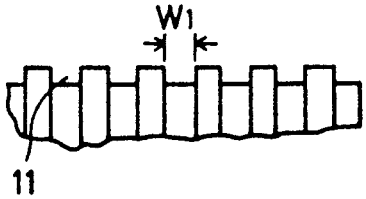
FIG.4B PRIOR ART
Figure 5A:
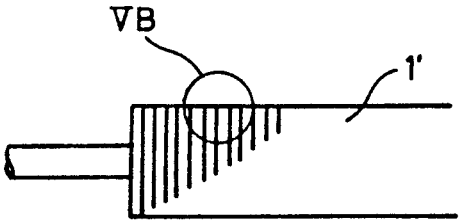
FIG.5A PRIOR ART
FIGS. 5A and 5B show grooves of a coating roll of an outlet side roll coater in accordance with the conventional improved roll coating method.
Figure 5B:
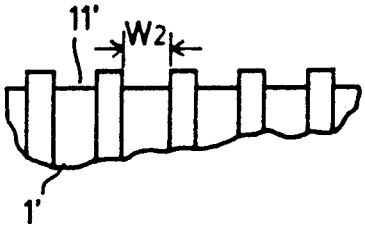
FIG.5B PRIOR ART
Figure 6:
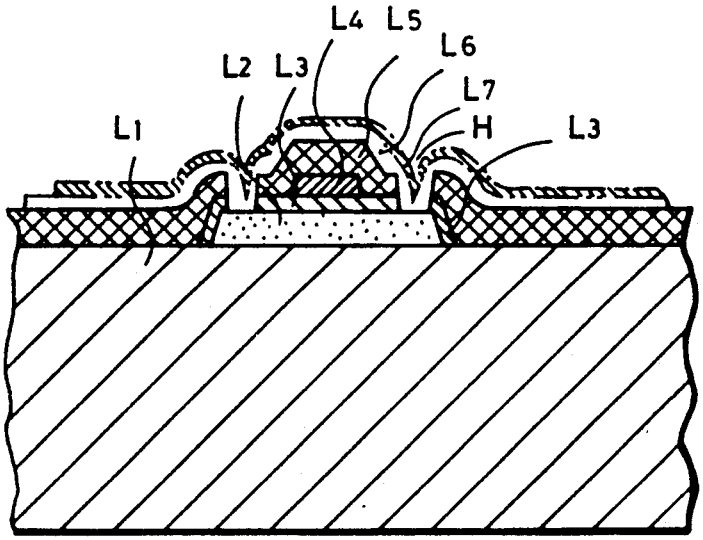
FIG.6 PRIOR ART
FIGS. 6 and 7 are cross sectional views for illustrating manufacturing process of a polysilicon TFT for liquid crystal.
Figure 7:
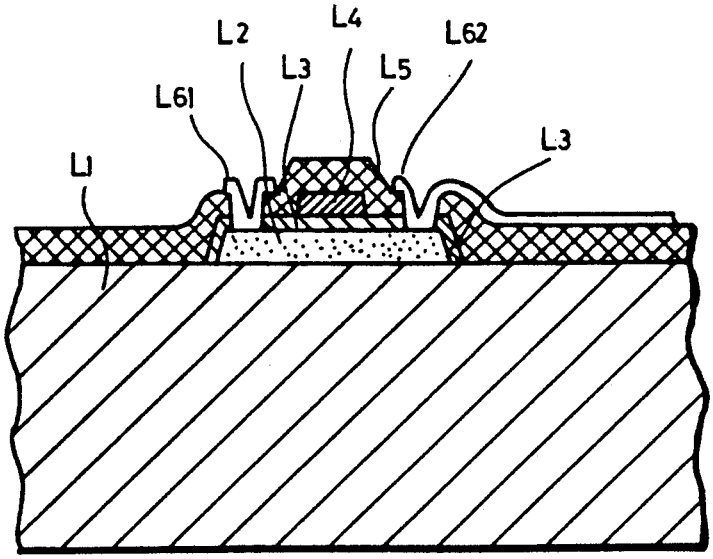
FIG.7 PRIOR ART
Figure 8:
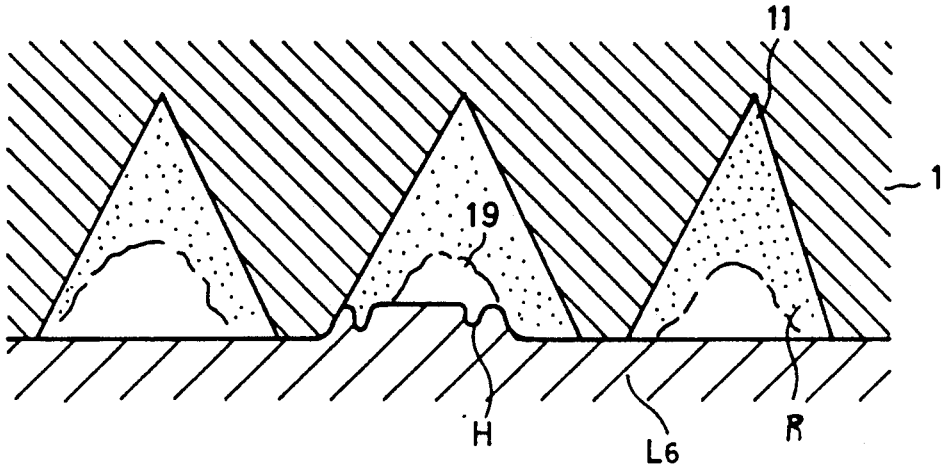
FIG.8 PRIOR ART
FIG. 8 illustrates a main condition of generation of the pin holes.
Figure 13A:
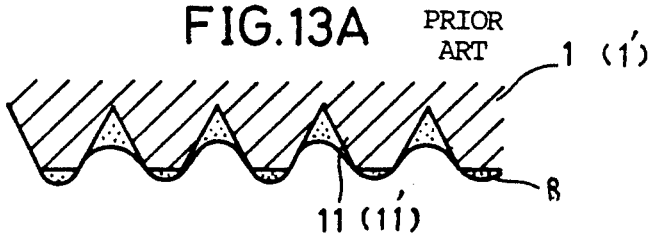
FIG.13A PRIOR ART
FIGS. 13A, 13B and 13C are cross sectional views of the coating roll showing the state of the coating liquid applied onto the surface of the coating roll.
Figure 13B:
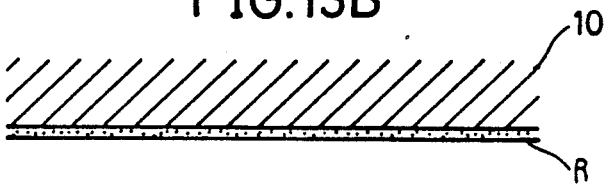
Figure 13C:
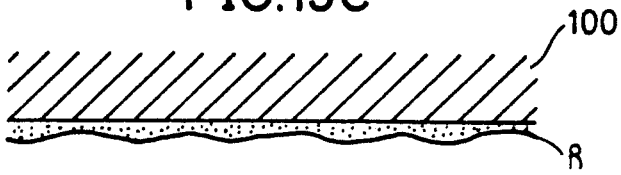

FIGS. 13A, 13B and 13C are cross sectional views showing how the coating liquid is applied on the surface of the coating roll. FIG. 13A shows a case in which the coating liquid R is applied on the grooves 11 and 11' and in the concave portions of the grooves of the conventional coating rolls 1 and 1' shown in FIGS. 1 and 3. FIG. 13B shows a case in which the coating liquid R is uniformly applied on the smooth surface of the coating roll 10 of the roll coating apparatus in accordance with the first embodiment of the present invention shown in FIG. 9. FIG. 13C shows a case in which the coating liquid R is applied on the smooth surface of the coating roll 100 of the roll coater as shown in FIG. 11. When the coating liquid is applied on the surface of the coating roll in a manner such as shown in FIG. 13B or 13C, the coating liquid R can be uniformly applied on the surface of the substrate S by the pressure of the coating roll, even if there are minute concave portions on the surface of the substrate S.

After the coating liquid is applied on the surface of the substrate S of the coating roll 100 of the roll coater A, the surface of the substrate S is preferably heated to a prescribed temperature so as to uniformly flatten the coating film rapidly. If the coating liquid is a positive photoresist or a polyimide resin, the surface of the substrate is heated to about 100° C. so as to make flat the coating film uniformly at high speed.

According to the fourth embodiment of the present invention, the coating roll of the roll coating apparatus comprises a smooth cylindrical outer surface, and the coating roll and the back up roll presses a substrate with a prescribed pressure. Since no groove is formed on the coating roll, the coating liquid is forced to fill the concave portions such as contact holes, if any, on the substrate. Therefore, a roll coating apparatus can be provided by means of which the coating can be applied without generating any pin hole even on a substrate having minute concave portions and convex portions on the surface thereof.

Although the provision of the back up roll is made to sandwich the substrate with the coating roll while conveying the same in the above embodiments, the present invention is not limited to such provision. For example, a horizontal transporting mechanism such as a belt conveyor may be replaced for the back up roll to fulfill the same function.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An apparatus for coating a substrate, the apparatus comprising:

(A) first coating liquid applying means for applying a first layer of coating liquid onto a generally flat substrate, the first coating liquid applying means including:

1. conveying means for conveying the substrate though the first coating liquid applying means in a downstream direction; and
2. a coating roller for nipping the substrate between the conveying means and the coating roller as the substrate is conveyed by the conveying means and for applying the first layer of coating liquid onto a surface of the substrate, the coating roller being positioned relative to the conveying means so as to be in contact with the surface of the substrate as the substrate is conveyed by the conveying means, the coating roller having a smooth cylindrical outer surface so as to force the first layer of coating liquid into minute concave portions formed in the surface of the substrate; and concave portions formed in the surface of the substrate; and (B) second coating liquid applying means for applying a second layer of coating liquid onto the first layer of coating liquid, the second coating liquid applying means including a coating roller for applying the second layer of coating liquid onto the first layer of coating liquid, the coating roller of the second coating liquid applying means being positioned so as to be in contact with the surface of the substrate as the second layer of coating liquid is applied onto the first layer of coating liquid, the coating roller of the second coating liquid applying means having an outer surface including a plurality of grooves formed therein for controlling the amount of coating liquid which is applied onto the substrate.

2. The apparatus of claim 1, wherein the second coating liquid applying means includes a conveying means for conveying the substrate through the second coating liquid applying means in the downstream direction, the conveying means of the second coating liquid applying means being adjacent to the coating roller of the second coating liquid applying means so that the substrate is nipped between the conveying means of the second coating liquid applying means and the coating roller of the second coating liquid applying means as the substrate is conveyed by the conveying means of the second coating liquid applying means.

3. The apparatus of claim 2, wherein the first coating liquid applying means includes doctor means for uniformly supplying coating liquid to the coating roller of the first coating liquid applying means.

4. The apparatus of claim 3, wherein the second coating liquid applying means includes doctor means for supplying coating liquid to the coating roller of the second coating liquid applying means.

5. The apparatus of claim 4, wherein the coating roller of the second coating liquid applying means is formed of an elastomeric material.

6. The apparatus of claim 4, wherein the conveying means of the first coating liquid applying means includes a fixed back up roller.

7. The apparatus of claim 4, wherein the conveying means of the second coating liquid applying means includes a back up roller with a smooth outer surface.

8. The apparatus of claim 4, wherein the doctor means of the first coating liquid applying means includes a doctor roller.

9. The apparatus of claim 8, wherein a plurality of grooves are formed in the outer surface of the doctor roller.

10. The apparatus of claim 8, wherein the doctor roller is formed of metal.

11. A method of coating a substrate, the method comprising the steps of:

(A) conveying a generally flat substrate past a coating roller;

(B) applying a first layer of coating liquid onto a surface of the substrate by transferring coating liquid from a smooth cylindrical outer surface of a coating roller onto the surface of the substrate, the step of transferring coating liquid onto the surface of the substrate including forcing coating liquid into minute concave portions formed in the surface of the substrate;

(C) applying a second layer of coating liquid onto the first layer of coating liquid by transferring coating liquid from the outer surface of a second coating roller onto the first layer of coating liquid; and (D) controlling the amount of coating liquid which is applied onto the substrate by forming the outer surface of the second coating roller with a plurality of grooves.

12. The method of claim 11, wherein the substrate includes a main surface and a thin film transistor formed on the main surface, the minute concave portions being formed in the thin film transistor.

13. The method of claim 12, wherein the first and second layers of coating liquid include insulative material.

14. The method of claim 11 further comprising the step for controlling the amount of the coating liquid applied on to the substrate by varying the width of the grooves.

15. An apparatus for coating a substrate, the apparatus comprising:

(A) means for conveying a generally flat substrate past a coating roller;

(B) coating liquid applying means for applying a first layer of coating liquid onto a surface of the substrate by transferring coating liquid from a smooth cylindrical outer surface of a coating roller onto the surface of the substrate, the coating liquid applying means including means for forcing coating liquid into minute concave portions formed in the surface of the substrate;

(C) means for applying a second layer of coating liquid onto the first layer of coating liquid; and (D) means to vary the amount of coating liquid which is applied onto the substrate, the means including a second coating roller having an outer surface including a plurality of grooves formed therein.

* * * * *